US012123597B2

(12) United States Patent
Ohnari

(10) Patent No.: US 12,123,597 B2
(45) Date of Patent: Oct. 22, 2024

(54) VENTILATION HOOD

(71) Applicant: Samsung Electronics Co., Ltd., Suwon-si (KR)

(72) Inventor: Hiroto Ohnari, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 412 days.

(21) Appl. No.: 17/478,265

(22) Filed: Sep. 17, 2021

(65) Prior Publication Data

US 2022/0113035 A1 Apr. 14, 2022

(30) Foreign Application Priority Data

Oct. 8, 2020 (JP) ..... 2020-170703
Jun. 18, 2021 (KR) ..... 10-2021-0079646

(51) Int. Cl.
*F24C 15/20* (2006.01)

(52) U.S. Cl.
CPC ..... *F24C 15/2071* (2013.01)

(58) Field of Classification Search
CPC ..... F24C 15/2071; F24C 15/20; H05B 15/20
See application file for complete search history.

(56) References Cited

U.S. PATENT DOCUMENTS 6,621,058 B1 9/2003 Kim
8,389,917 B2 * 3/2013 Jeong ..... F24C 15/2092 219/757
10,040,149 B2 * 8/2018 Simmons ..... F24F 13/084
11,297,696 B2 * 4/2022 Lee ..... F24C 15/2071
2003/0023448 A1 * 1/2003 Geiger ..... F24C 15/2021 704/E15.045
2008/0156793 A1 * 7/2008 Song ..... H05B 6/6423 219/757
2008/0217329 A1 * 9/2008 Braunisch ..... H05B 6/6423 219/757
2008/0264933 A1 * 10/2008 Jeong ..... F24C 15/2092 219/757
2015/0053674 A1 * 2/2015 Liu ..... F24C 15/20 219/757
2020/0191410 A1 * 6/2020 Scalf ..... F24C 15/2085
2021/0348770 A1 * 11/2021 Bentley ..... B01D 46/0043

FOREIGN PATENT DOCUMENTS

JP 2008-082634 A 4/2008
KR 10-2006-0026333 A 3/2006
KR 10-2010-0009886 A 1/2010
KR 10-2017-0115672 A 10/2017

OTHER PUBLICATIONS

International Search Report dated Jan. 12, 2022; International Appln. No. PCT/KR2021/012762.

* cited by examiner

*Primary Examiner* — Avinash A Savani
(74) *Attorney, Agent, or Firm* — Jefferson IP Law, LLP

(57) ABSTRACT

A ventilation hood is provided. The ventilation hood includes a housing provided above a heating cooker and having an air suction port on a lower surface thereof, a blowing fan provided in the housing to induce air to the air suction port, and a panel provided below the housing to form an airflow path between the lower surface of the housing and the panel, wherein the panel faces the air suction port with a gap therebetween to cover the air suction port so that air is sucked into the airflow path from a front of an upstream opening of the airflow path as the blowing fan operates.

13 Claims, 14 Drawing Sheets

VENTILATION HOOD

CROSS-REFERENCE TO RELATED APPLICATION(S)

This application is based on and claims priority under 35 U.S.C. § 119(a) of a Japanese patent application number 2020-170703, filed on Oct. 8, 2020, in the Japanese Intellectual Property Office, and of a Korean patent application number 10-2021-0079646, filed on Jun. 18, 2021, in the Korean Intellectual Property Office, the disclosure of each of which is incorporated by reference herein in its entirety.

BACKGROUND

1. Field

The disclosure relates to a ventilation hood.

2. Description of Related Art

A ventilation hood is provided above a heating cooker to ventilate heat, steam, oil vapor, odor, and the like (hereinafter, collectively referred to as smoke and the like) generated during cooking. However, in recent years, there is a case in which another cooker such as a microwave oven is disposed above the heating cooker in a kitchen.

As a ventilation hood in such a kitchen, there is a ventilation hood including an air suction port provided on a lower surface of a housing of the microwave oven and, for example, a fan provided in the housing to draw smoke and the like to the air suction port by operating the fan and exhaust the smoke and the like through the inside of the housing.

In this configuration, since it is necessary to maximize the space as a cooking chamber or secure a space for arranging control devices, etc., in the housing, an airflow path of smoke etc. becomes narrow so that it is difficult to obtain a sufficient suction air volume.

The suction air volume may be increased by increasing a fan speed, but as described above, because the airflow path in the housing is narrow, it is difficult to effectively increase the suction air volume, and other problems such as increased power consumption and noise occur.

On the other hand, in order to improve a collection efficiency of a ventilation hood, e.g., the ventilation hood shown and described in Japanese Patent Publication No. 2008-082634, a panel to form an airflow path between the lower surface of the housing and the panel may be provided.

However, when smoke and the like are generated just below the panel, the smoke and the like may be drawn into the airflow path between the panel and the lower surface of the housing, but for example, when a pot or the like is placed on a front side (in front) of the panel so that smoke and the like rise from the outside of the panel during cooking, a part of the smoke and the like is not collected and diffuses into a room, which deteriorates the comfort of an indoor environment.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a ventilation hood, which is installed in a kitchen provided with a housing of a microwave oven or the like disposed above a heating cooker, capable of increasing a collection efficiency compared to the conventional art and collecting smoke and the like as much as possible.

Additional aspects will be set forth in part in the description which follows and, in part, will be apparent from the description, or may be learned by practice of the presented embodiments.

In accordance with an aspect of the disclosure, a ventilation hood is provided. The ventilation hood includes a housing provided above a heating cooker and having an air suction port on a lower surface thereof, a blowing fan provided in the housing to induce air to the air suction port, and a panel provided below the housing to form an airflow path between the lower surface of the housing and the panel, wherein the panel is arranged such that a negative pressure is generated in a front of an upstream opening of the airflow path by the operation of the blowing fan.

Herein, the expression "in front of an upstream opening" refers to a space being further from a forward side with respect to the upstream opening that is open toward the front side, and refers to a space being in further from a lateral side with respect to the upstream opening that is open toward the lateral side.

According to the ventilation hood configured as described above, because the panel is arranged such that a negative pressure is generated in front of the upstream opening of the airflow path, even when smoke and the like rise from the outside of the panel, the smoke and the like may be drawn into the airflow path by the negative pressure, so that even in the kitchen where the housing is provided above the heating cooker, smoke and the like may be collected as much as possible.

In order to generate a negative pressure for collecting smoke and the like as much as possible, it is suitable that a distance from an upper surface of the panel to the lower surface of the housing in a height direction is 100 mm or less, and particularly 50 mm or less.

Herein, specific experimental data will be described later.

When the panel is positioned in front of a front surface of the housing, the panel is disturbed in cooking.

Therefore, in order to generate negative pressure without disturbing cooking by the panel, in a configuration in which a front end of the panel is positioned in front of the front surface of the housing, it is suitable that a distance from the front surface of the housing to the front end of the panel in a front-rear direction is 100 mm or less.

With this configuration, the panel is not disturbed in cooking and a collection efficiency of smoke and the like may be increased.

In order to generate a negative pressure for collecting smoke and the like as much as possible, in a configuration in which the front end of the panel is positioned in the rear of the front surface of the housing, it is suitable that a distance from the front surface of the housing to the front end of the panel in the front-rear direction is 100 mm or less.

Herein, specific experimental data will be described later.

In order to prevent a finger of a user or the like from entering the upstream opening of the airflow path and to enable air suction, it is suitable that a grill having a grid shape is provided in the upstream opening of the airflow path.

It is suitable that the housing includes an air exhaust port to allow the air sucked from the air suction port to be discharged into a room, and a deodorizing part is provided in an internal airflow path to communicate the air suction port and the air exhaust port.

With this configuration, the comfort of an indoor environment is not deteriorated by the odor of smoke and the like, and the collected air may be circulated.

In addition, as another specific embodiment, a configuration in which the upstream opening of the airflow path is provided on the front surface of the housing may be exemplified.

As a more specific embodiment, a form in which the housing constitutes a cooker different from the heating cooker may be exemplified.

As a form in which the action and effect according to the disclosure are more remarkably exhibited, it is suitable that the cooker includes a touch panel provided on the housing.

With this configuration, deterioration of the operability of the touch panel may be prevented due to the effect of increasing the collection efficiency of smoke and the like by the disclosure.

In addition, as another form in which the action and effect according to the disclosure are more remarkably exhibited, the cooker having a voice recognition function may be exemplified.

With this configuration, because by the effect of increasing the collection efficiency of smoke and the like by the disclosure, for example, even when a small motor is used for the blowing fan or a rotation speed of the blowing fan is lowered, the smoke and the like may be collected as much as possible, noise may be reduced compared to the conventional art, so that the voice recognition function may be secured.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, of which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
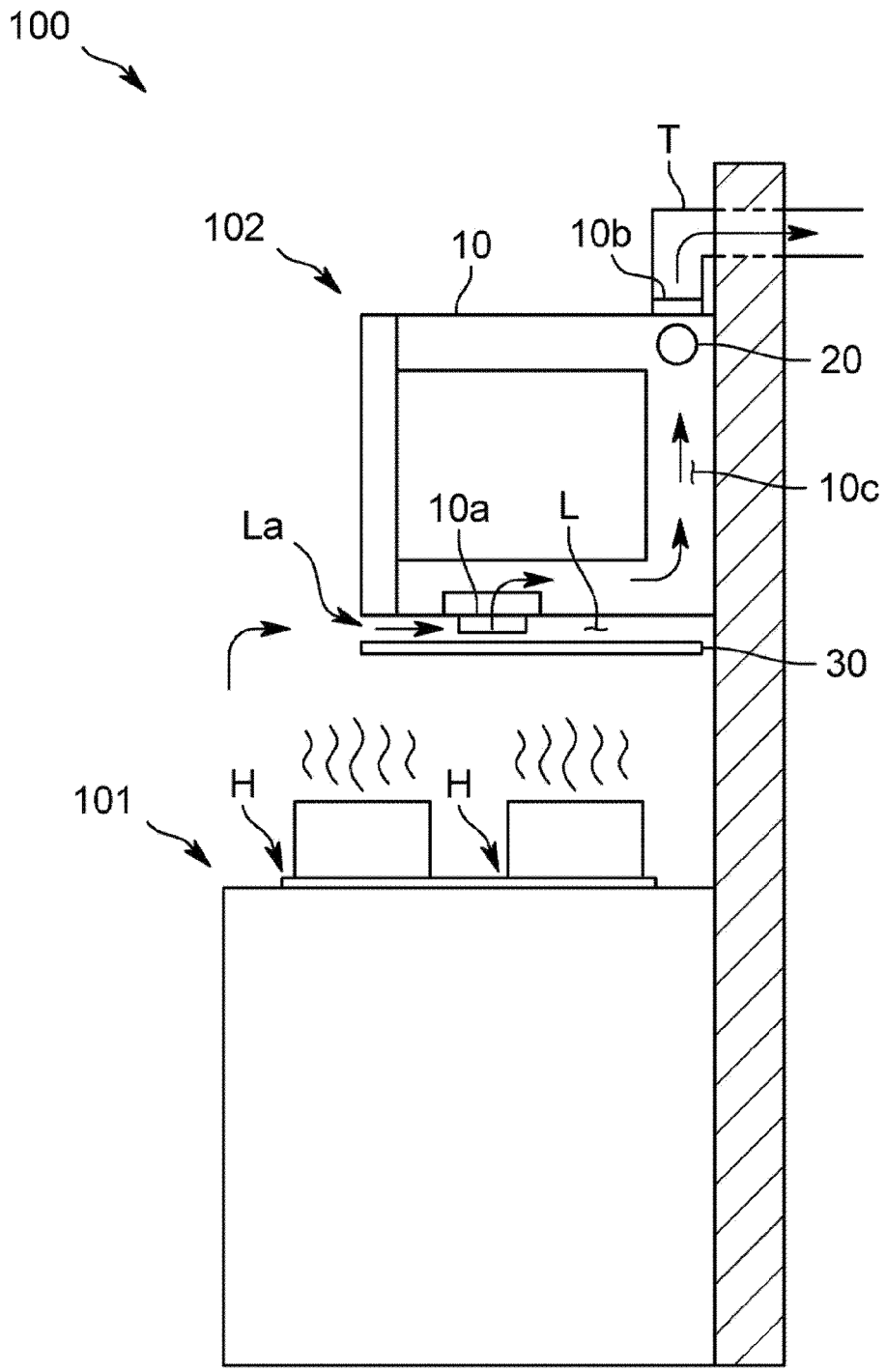
FIG. 1 is a schematic view illustrating the overall configuration of a ventilation hood according to an embodiment of the disclosure.

FIG. 1 is a schematic view illustrating the overall configuration of a ventilation hood according to an embodiment of the disclosure.

Referring to FIG. 1, a ventilation hood 100 according to the embodiment is provided above a heating cooker 101 to ventilate smoke and the like generated during cooking.

The heating cooker 101 is provided with at least one heating part H on an upper surface of which an object to be heated such as a pot and a frying pan for accommodating ingredients is placed. One of the heating part H may be provided or a plurality of the heating parts H may be provided. As a heating method, gas, an electric heater, an electromagnetic induction heating device, etc. may be provided. In the embodiment, the plurality of heating part H is provided, and at least one of the heating parts H is located on a front side (in front) of the ventilation hood 100.

In the embodiment, a microwave oven 102 is provided above the heating cooker 101. Although the configuration or function of the microwave oven 102 is not particularly limited, for example, a touch panel for controlling various operations of the microwave oven 102 may be provided on a front surface thereof, etc., and a voice recognition function may be provided. The microwave oven 102 is not necessarily provided above the heating cooker 101, and other cookers may be provided.

Referring to FIG. 1, the ventilation hood 100 according to the embodiment includes a housing 10 provided above the heating cooker 101, a blowing fan 20 provided in the housing 10, and a panel 30 provided below the housing 10.

Figure 2:
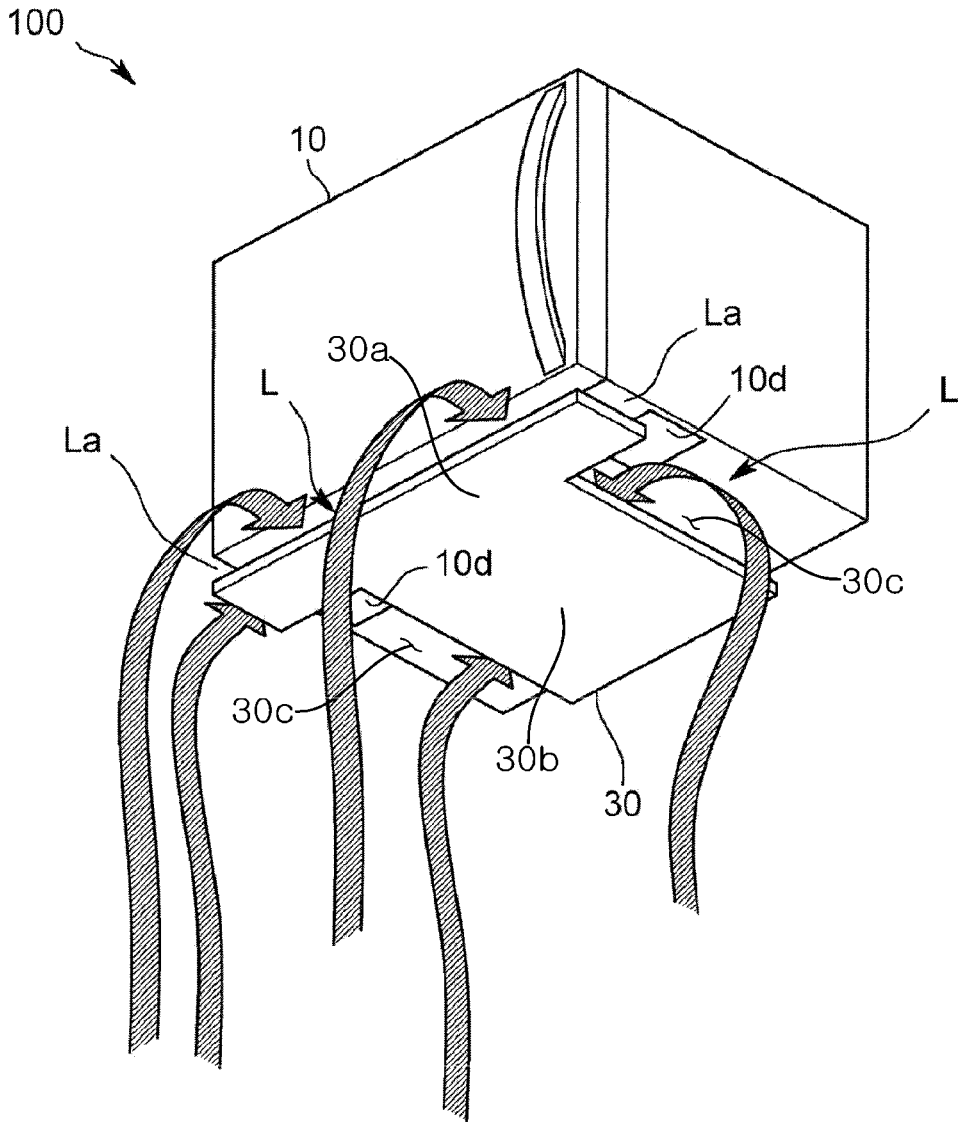
FIG. 2 is a perspective view of the ventilation hood according to an embodiment of the disclosure.

As illustrated in FIGS. 1 and 2, the housing 10 constitutes a cooking chamber of the microwave oven 102 described above, and an air suction port 10*a* is formed on a lower surface thereof, and an air exhaust port 10*b* is formed, for example, on an upper rear portion thereof.

An internal airflow path 10*c* for communicating the air suction port 10*a* and the air exhaust port 10*b* is formed inside the housing 10, and the internal airflow path 10*c* is formed avoiding the cooking chamber or a control device (not shown) provided in the housing 10.

Referring to FIG. 1, the blowing fan 20 is provided in the internal airflow path 10*c* of the housing 10, and includes a motor as a power source. Therefore, as the blowing fan 20 operates, smoke and the like generated during cooking are sucked into the air suction port 10*a*, and then pass through the internal airflow path 10*c* of the housing 10 and are discharged from the air exhaust port 10*b*. In this case, a duct member T is connected to the air exhaust port 10*b*, so that the smoke and the like are discharged to the outside through the duct member T.

FIG. 2 is a perspective view of the ventilation hood according to an embodiment of the disclosure.

Referring to FIGS. 1 and 2, the panel 30 forms an airflow path L through which smoke and the like moves between the lower surface of the housing 10 and the panel 30 and may have a flat plate shape, for example. The panel 30 has a structure detachable from the housing and may include a front part 30*a* positioned on a front side (in front) and a closure part 30*b* disposed on a rear side (in rear) of the front part 30*a*. The closure part 30*b* is provided to cover at least the air suction port 10*a*, and an opening 30*c* may be disposed on right and left sides of the closure part 30*b*. Referring to FIG. 2, the opening 30*c* includes a portion corresponding to a lighting part 10*d* provided on the lower surface of the housing 10, so that the panel 30 has a shape that does not cover the lighting part 10*d*. However, the panel 30 is not limited thereto, and may be changed into various shapes such as a rectangle, a circle, and a polygon.

Figure 3:
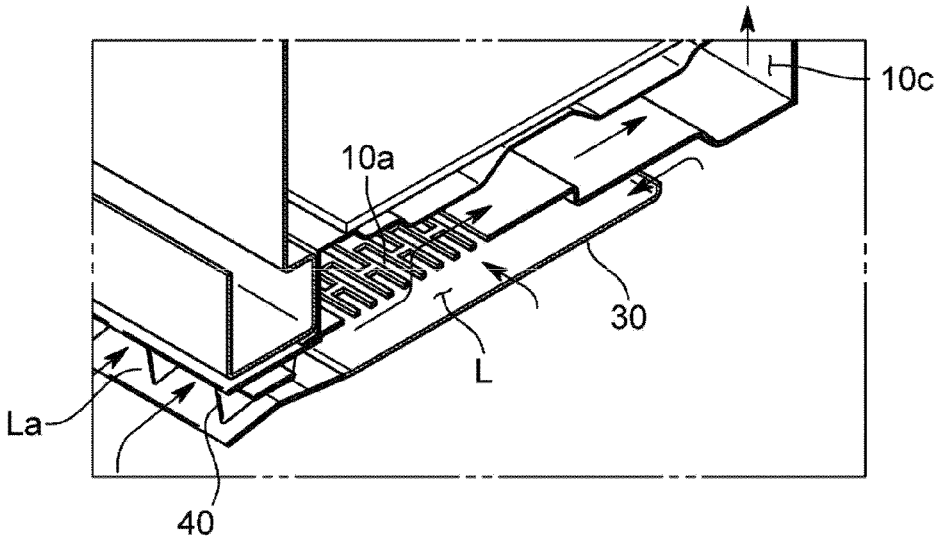
FIG. 3 is a perspective view illustrating a partial cross-section of an internal structure of the ventilation hood according to an embodiment of the disclosure.

Referring to FIGS. 2 and 3, the airflow path L formed between an upper surface of the panel 30 and the lower surface of the housing 10 is configured to allow smoke and the like to be introduced from the front side, the right side, the left side, and the rear side to guide the introduced the smoke and the like to the air suction port 10*a*. That is, the airflow path L is configured such that an upstream opening La is open in all directions and a downstream side thereof is in communication with the air suction port 10*a*.

FIG. 3 is a perspective view illustrating a partial cross-section of an internal structure of the ventilation hood according to an embodiment of the disclosure.

Referring to FIG. 3, in order to prevent a finger of a user or the like from entering the upstream opening La, which is open toward the front side, a grill 40 having a grid or other shape is provided in the upstream opening La. The grill 40 is detachably provided, and for example, when a position of the upstream opening La is high and safety is ensured, the grill 40 may be removed.

The panel 30 according to the embodiment is disposed such that a negative pressure is generated in front of the upstream opening La of the airflow path L as the blowing fan 20 operates.

The expression "in front of the upstream opening La" refers to a space being further from the front side with respect to the upstream opening La that is open toward the front side, and refers to a space being further from a lateral side with respect to the upstream opening La that is open toward the lateral side.

Figure 4A:
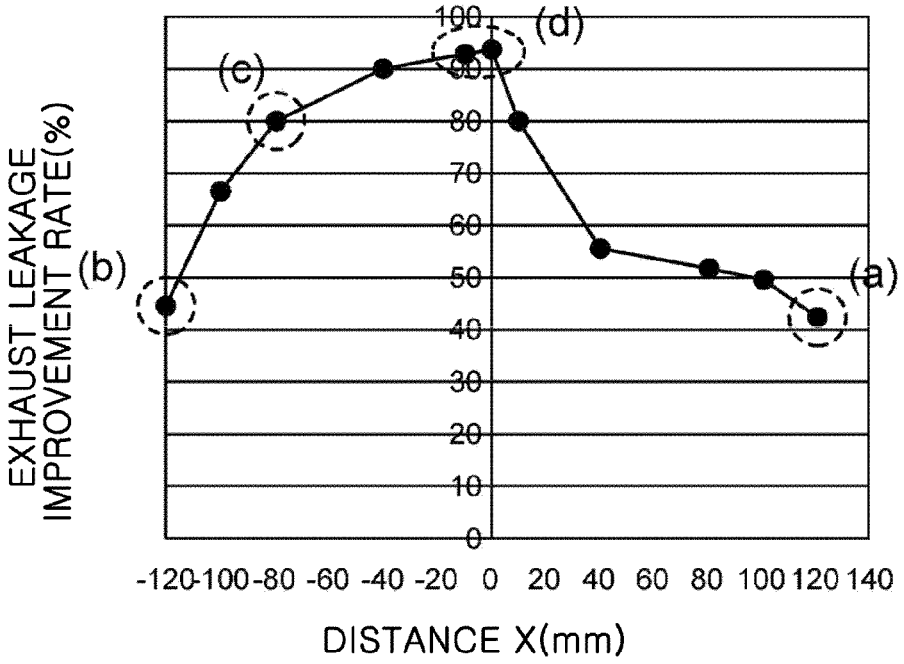
FIG. 4A is a graph illustrating a correlation between a distance X from a front surface of a housing to a front end of a panel in a front-rear direction and an exhaust leakage improvement rate according to an embodiment of the disclosure.

FIG. 4A is a graph illustrating a correlation between a distance X from a front surface of a housing to a front end of a panel in a front-rear direction and an exhaust leakage improvement rate according to an embodiment of the disclosure.

Figure 4B:
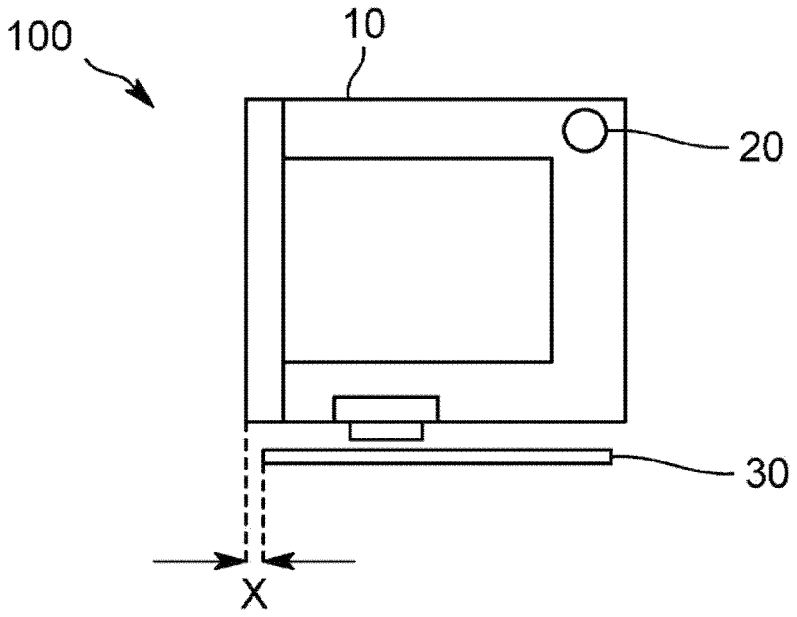
FIG. 4B is a schematic view for illustrating the distance X from the front surface of the housing to the front end of the panel in the front-rear direction according to an embodiment of the disclosure.

FIG. 4B is a schematic view for illustrating the distance X from the front surface of the housing to the front end of the panel in the front-rear direction according to an embodiment of the disclosure.

Referring to FIG. 4A, a graph illustrates a correlation between a distance X from a front surface of the housing 10 to a front end of the panel 30 in a front-rear direction and an exhaust leakage improvement rate. The distance X from the front surface of the housing 10 to the front end of the panel 30 in the front-rear direction is the same as that shown in a schematic view of FIG. 4B.

The exhaust leakage improvement rate is a ratio between a leakage amount Zon at a front surface when the ventilation hood 100 is turned on and a leakage amount Zoff at the front surface when the ventilation hood 100 is turned off, and more specifically, is calculated by the following calculation formula.

$$\text{Exhaust leakage improvement rate (\%)} = (1 - Zon/Zoff) \times 100$$

Figure 5:
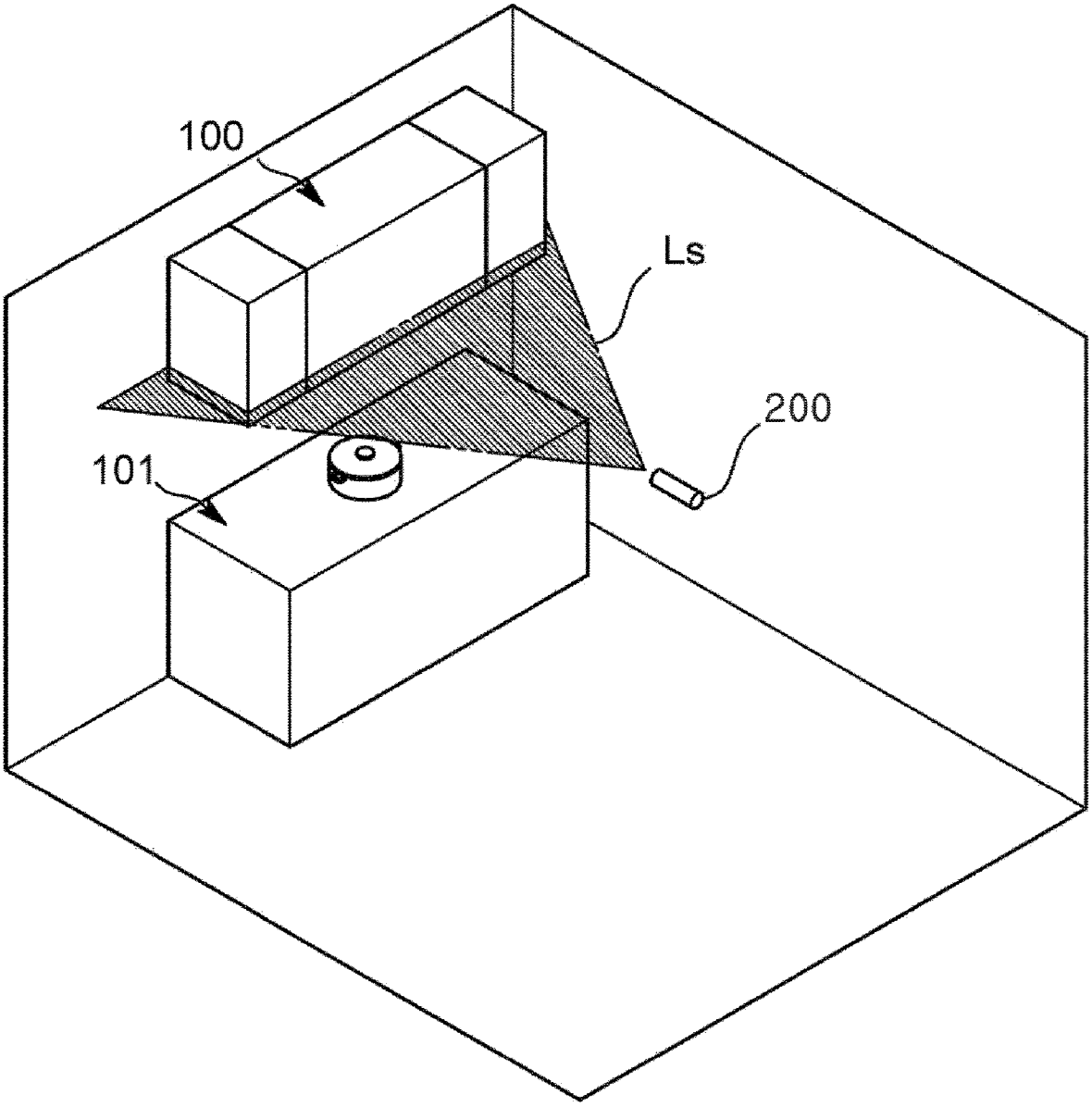
FIG. 5 is a schematic view for explaining a measuring method of a leak amount according to an embodiment of the disclosure.
Figure 6A:
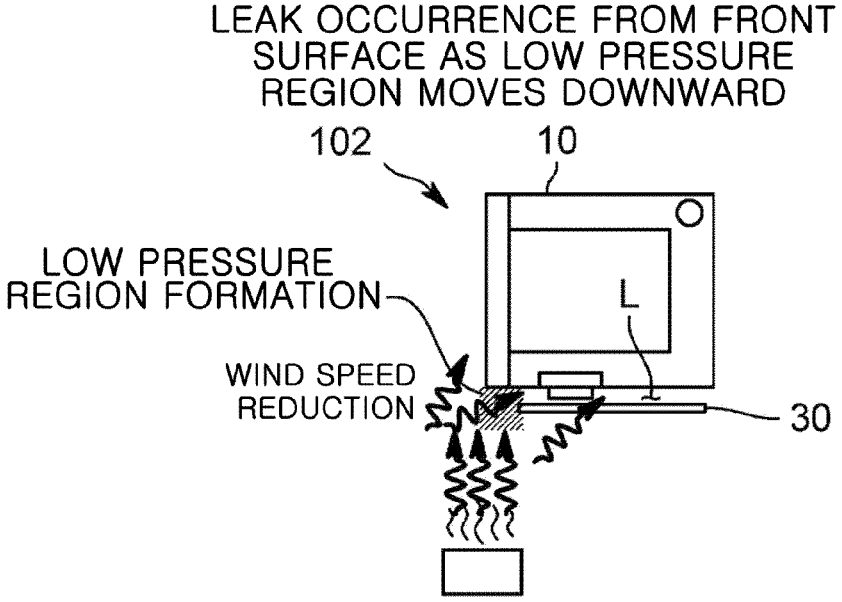
FIGS. 6A, 6B, 6C, and 6D are schematic views illustrating relationships between the above-described distance X and an exhaust leak according to various embodiments of the disclosure.
Figure 6B:
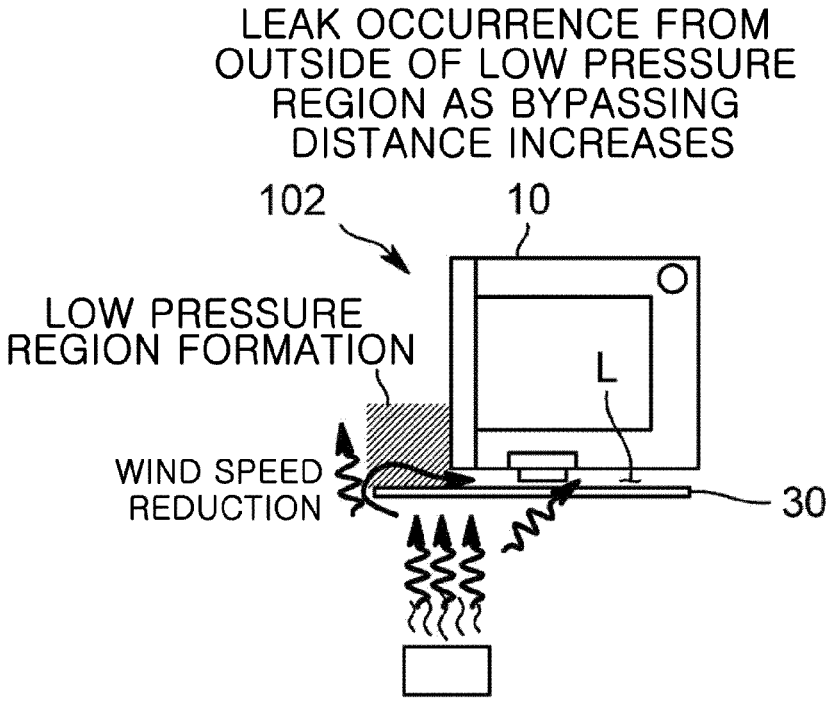
Figure 6C:
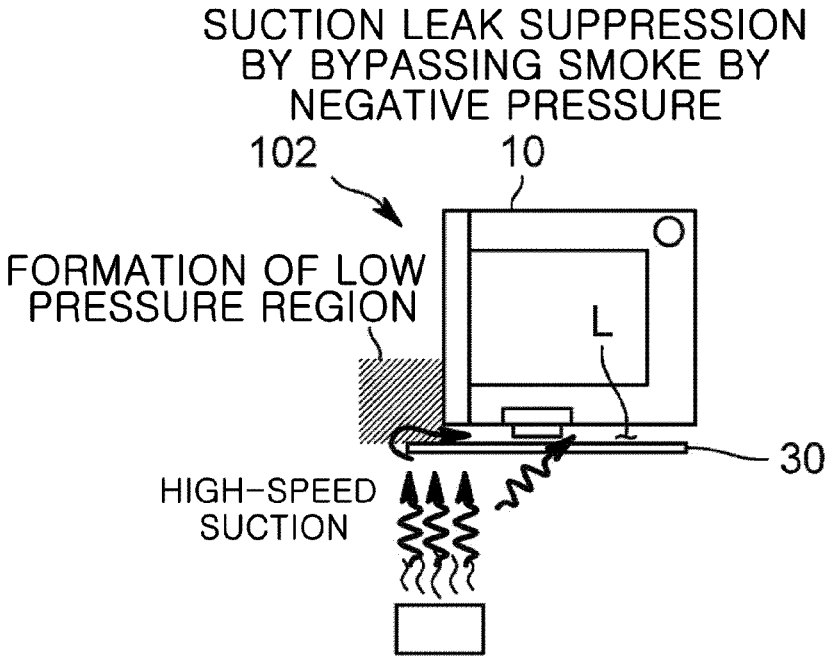
Figure 6D:
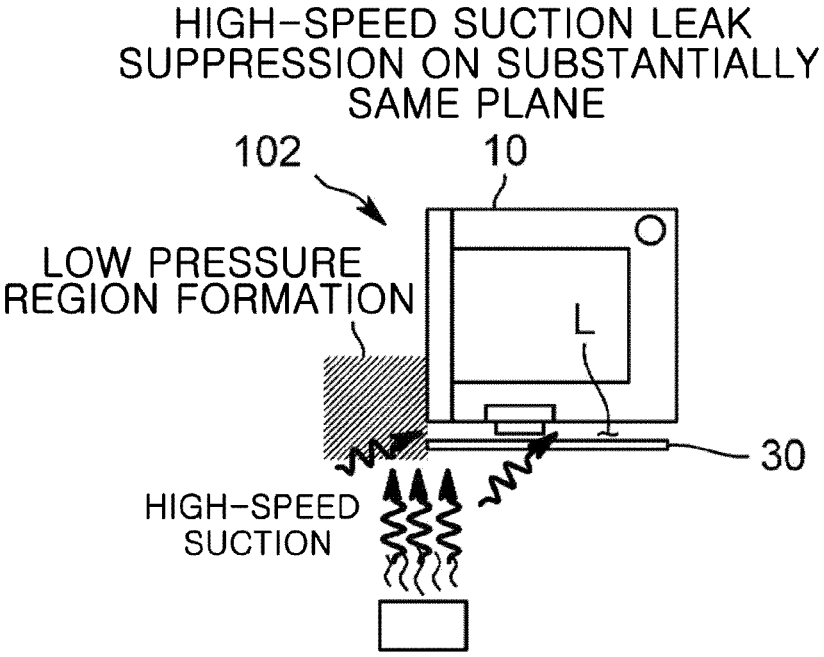

FIG. 5 is a schematic view for explaining a measuring method of a leak amount according to an embodiment of the disclosure.

Referring to FIG. 5, the leakage amounts Zon and Zoff are obtained, for example, by emitting a planar laser light LS from a planar laser light emitting device 200 above the heating cooker 101, photographing smoke and the like passing through the planar laser light LS, and analyzing an image thereof.

FIGS. 6A to 6D are schematic views illustrating relationships between the above-described distance X and an exhaust leak according to various embodiments of the disclosure.

As may be seen from the correlation of the graph referring to FIG. 4A, in a configuration in which the front end of the panel 30 is positioned in the rear of the front surface of the housing 10, when the distance X exceeds 100 mm, and in a configuration in which the front end of the panel 30 is positioned in front of the front surface of the housing 10, when the distance X exceeds −100 mm, the exhaust leakage improvement rate is reduced to less than 50%. This is because, referring to FIG. 6A, in the configuration in which the front end of the panel 30 is positioned in the rear of the front surface of the housing 10, as the distance X increases, a negative pressure region for sucking smoke and the like moves downward, so that an exhaust leak occurs. Also, this is because, referring to FIG. 6B, in the configuration in which the front end of the panel 30 is positioned in front of the front surface of the housing 10, smoke and the like, which have collided with panel 30, are bypassed and sucked into the panel 30, but an exhaust leak occurs in a region outside a low pressure region.

For this reason, in the configuration of the embodiment in which the front end of the panel 30 is positioned in the rear of the front surface of the housing 10, the distance X is set to be 100 mm or less, and specifically, the distance X is set to 0 mm, that is, the front surface of the housing 10 and a front surface of the panel 30 are formed to be on the same plane. Accordingly, referring to FIG. 6C, a suction leak may be suppressed by bypassing smoke and the like by the negative pressure generated in front of the upstream opening La, and by setting the distance X to be 0 mm as described above, referring to FIG. 6D, the suction leak due to a high-speed suction may be further suppressed.

In the configuration in which the front end of the panel 30 is positioned in front of the front surface of the housing 10, when the distance X exceeds 100 mm, an exhaust leak occurs as described above, and furthermore, the panel 30 is obstructed in cooking. For this reason, in the configuration in which the front end of the panel 30 is positioned in front of the front surface of the housing 10, it is suitable that the distance X is 100 mm or less.

Figure 7A:
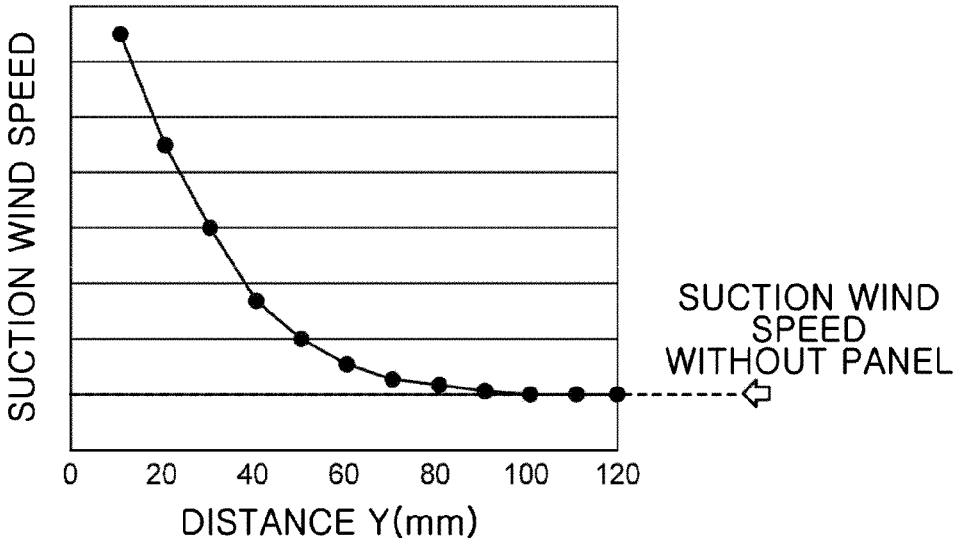
FIG. 7A is a graph illustrating a correlation between a distance Y from an upper surface of the panel to a lower surface of the housing in a height direction and a suction wind speed according to an embodiment of the disclosure.

FIG. 7A is a graph illustrating a correlation between a distance Y from an upper surface of the panel to a lower surface of the housing in a height direction and a suction wind speed according to an embodiment of the disclosure.

Figure 7B:
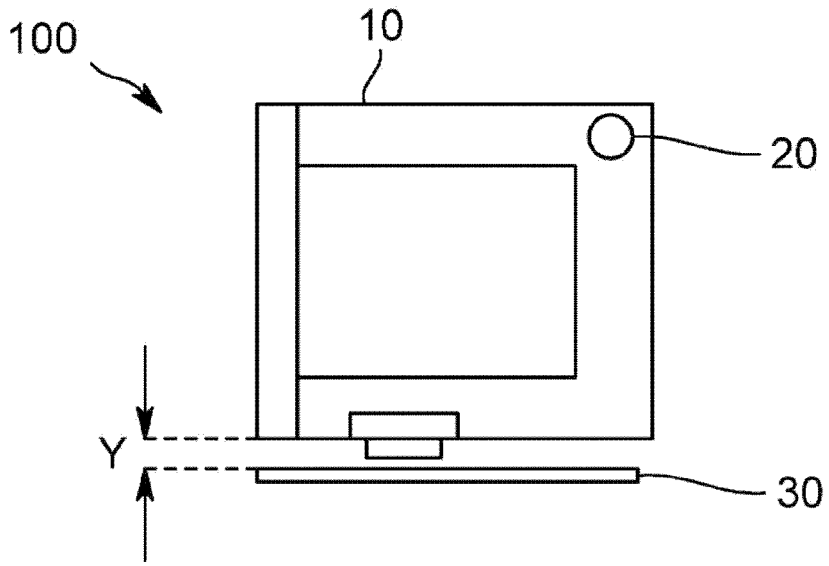
FIG. 7B is a schematic view for illustrating the distance Y from the upper surface of the panel to the lower surface of the housing in the height direction according to an embodiment of the disclosure.

FIG. 7B is a schematic view for illustrating the distance Y from the upper surface of the panel to the lower surface of the housing in the height direction according to an embodiment of the disclosure.

Referring to FIG. 7A, a graph illustrates a correlation between a distance Y from the upper surface of the panel 30 to the lower surface of the housing 10 in a height direction and a suction wind speed. The distance Y from the upper surface of the panel 30 to the lower surface of the housing 10 in the height direction is the same as that shown in a schematic view of FIG. 7B.

As may be seen from this correlation, when the distance Y is 100 mm or more, the suction wind speed becomes the same as a suction wind speed when there is no panel, so it may be difficult to form a negative pressure. On the other hand, as the distance Y from the panel 30 decreases from 100 mm, the suction wind speed increases, so that a negative pressure is generated in front of the upstream opening La of the airflow path L.

Therefore, in the embodiment, the distance Y may be set to 100 mm or less, and may be 50 mm or less.

According to the ventilation hood 100 configured as described above, because the panel 30 is arranged such that a negative pressure is generated in front of the upstream opening La of the airflow path L, even when smoke and the like rise from the outside of the panel 30, the smoke and the like may be drawn into the airflow path L by the negative pressure, so that even in the kitchen where the housing 10 is provided above the heating cooker 101, smoke and the like may be collected as much as possible.

By setting the distance X from the front surface of the housing 10 to the front end of the panel 30 in the front-rear direction to −80 mm to 20 mm, as illustrated in FIG. 4A, the exhaust leakage improvement rate of 80% or more may be secured, and in particular, in the embodiment, because the distance X is set to 0 mm, the exhaust leakage improvement rate of 90% or more may be secured.

The disclosure is not limited to the above embodiment.

For example, in the ventilation hood 100 of the above embodiment, the distance X is 100 mm or less, and the distance Y is 100 mm or less, but in the ventilation hood 100 according to the disclosure, the distance X may be 100 mm or less, or the distance Y may be 100 mm or more.

Figure 8:
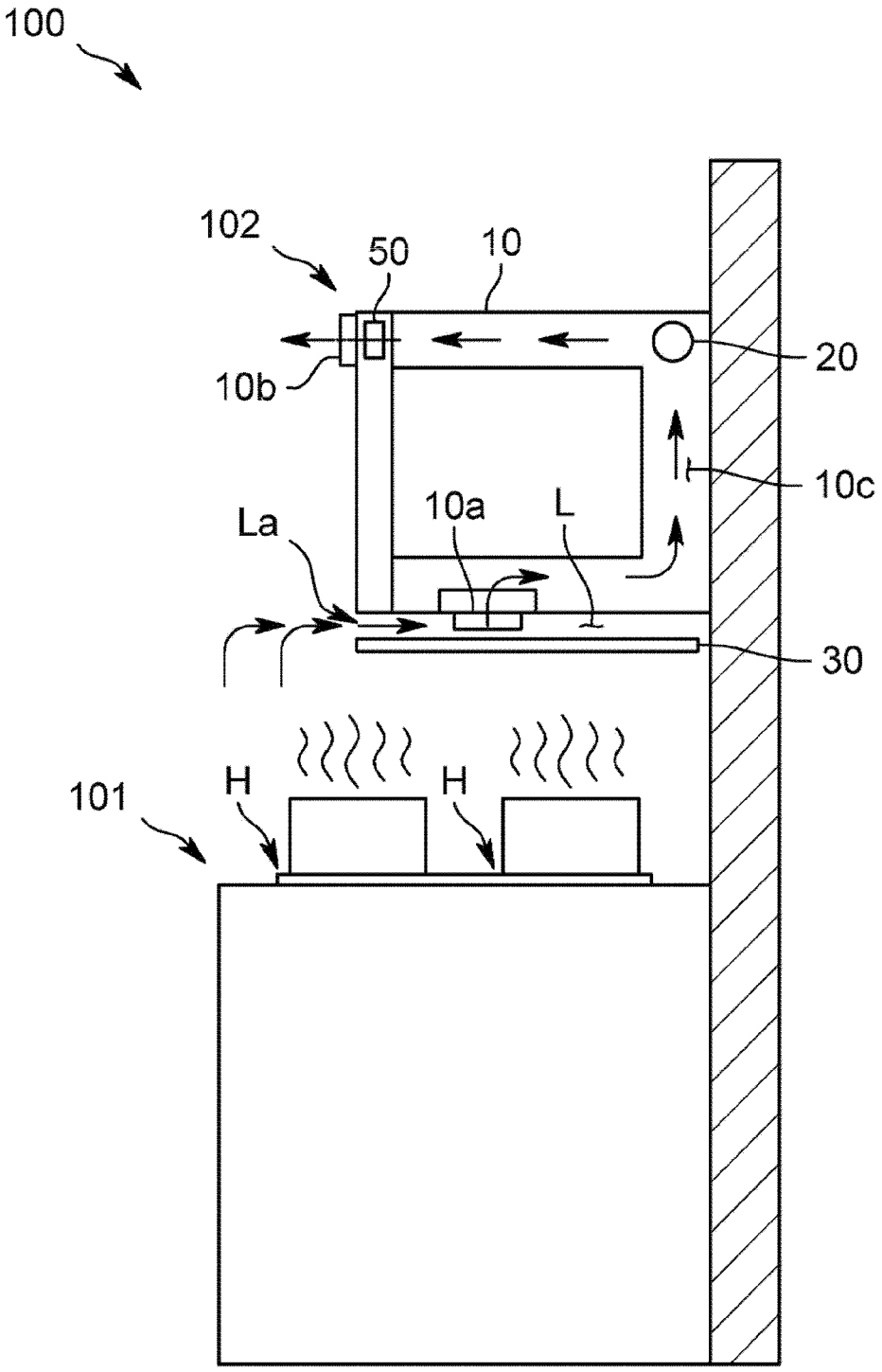
FIG. 8 is a schematic view illustrating the overall configuration of a ventilation hood according to an embodiment of the disclosure.

FIG. 8 is a schematic view illustrating the overall configuration of a ventilation hood according to an embodiment of the disclosure.

In addition, although the above embodiment illustrates that smoke and the like are discharged to the outdoors, referring to FIG. 8, a deodorizing part 50 is provided in the airflow path L for communicating the air suction port 10*a* and the air exhaust port 10*b*, so that a configuration may be provided in which the sucked smoke and the like are deodorized and returned back to a room.

Figure 9:
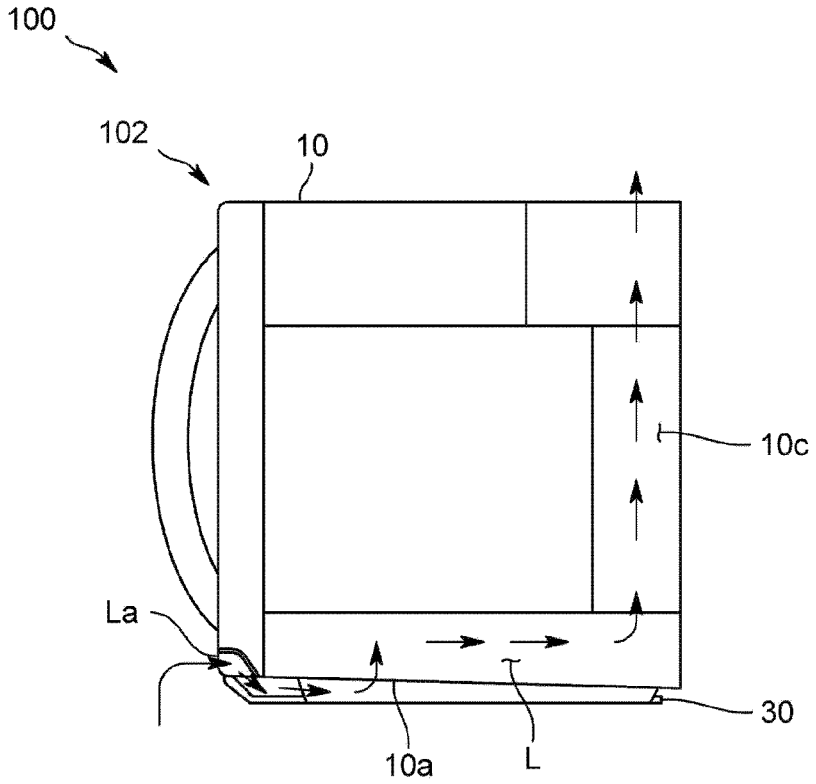
FIG. 9 is a schematic view illustrating the overall configuration of a ventilation hood according to an embodiment of the disclosure.

FIG. 9 is a schematic view illustrating the overall configuration of a ventilation hood according to an embodiment of the disclosure.

Referring to FIG. 9, because the airflow path L formed between the upper surface of the panel 30 and the lower surface of the housing 10 extends to the inside of the housing 10, the upstream opening La of the airflow path L may be formed on the front surface of the housing 10.

As is apparent from the above, according to the disclosure, a ventilation hood, which is provided in a kitchen provided with a microwave oven and the like above a heating cooker, can increase a collection efficiency compared to the conventional art and collect smoke and the like as much as possible.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A ventilation hood comprising:

a housing provided above a heating cooker and having an air suction port and at least one lighting part on a lower surface thereof;

a blowing fan provided in the housing to induce air to the air suction port;

a panel provided below the housing to form an airflow path between the lower surface of the housing and the panel; and a detachable grill having a grid shape and disposed vertically to the panel in an upstream opening of the airflow path to prevent a finger of a user from entering the upstream opening, wherein the panel faces the air suction port with a gap therebetween to cover the air suction port so that air is sucked into the airflow path from a front of the upstream opening of the airflow path as the blowing fan operates, wherein the panel comprises a front part, a closure part disposed in a rear of the front part to cover the air suction port, and an opening formed on right and left sides of the closure part, wherein the front part has a width larger than a width of the closure part so that the opening is formed by a portion of the front part and a portion of the closure part, and wherein the opening of the panel comprises a portion corresponding to the at least one lighting part.

2. The ventilation hood according to claim 1, wherein the panel covers the air suction port so that air moved upward from the heating cooker bypasses an outer edge of the panel and is introduced into the airflow path from a front side, a right side, a left side, and a rear side of the panel.

3. The ventilation hood according to claim 1, wherein a distance from an upper surface of the panel to the lower surface of the housing in a height direction is 100 mm or less.

4. The ventilation hood according to claim 1, wherein a front end of the panel is positioned in front of a front surface of the housing, and wherein a distance from the front surface of the housing to the front end of the panel in a front-rear direction is 100 mm or less.

5. The ventilation hood according to claim 1, wherein a front end of the panel is positioned in a rear of a front surface of the housing, and wherein a distance from the front surface of the housing to the front end of the panel in a front-rear direction is 100 mm or less.

6. The ventilation hood according to claim 1, wherein the housing comprises a microwave oven, and wherein the air suction port is formed on a lower surface of the microwave oven.

7. The ventilation hood according to claim 1, wherein the housing further comprises:

an air exhaust port to allow the air sucked from the air suction port to be discharged into a room, and an internal airflow path between the air suction port and the air exhaust port.

8. The ventilation hood according to claim 7, wherein a duct member is connected to the air exhaust port, and wherein a deodorizing part is provided in the internal airflow path.

9. The ventilation hood according to claim 1, wherein the upstream opening of the airflow path is formed on a front surface of the housing.

10. The ventilation hood according to claim 1, wherein the housing comprises a cooker different from the heating cooker.

11. The ventilation hood according to claim 10, wherein the cooker comprises a touch panel provided on the housing.

12. The ventilation hood according to claim 10, wherein the cooker comprises a voice recognition function.

13. The ventilation hood according to claim 2, wherein the panel is detachably mounted to the housing.

* * * * *